US005611676A

United States Patent [19]

Ooumi et al.

[11] Patent Number: 5,611,676

[45] Date of Patent: Mar. 18, 1997

[54] MICROPUMP

[75] Inventors: Takeharu Ooumi, Toyota; Yoshihiro Naruse; Takahiro Yamada, both of Ichikawa; Kinji Tsukahara, Seki; Mitsuhiro Ando, Toyohashi; Katsuya Tsuchimoto, Anjou, all of Japan

[73] Assignee: Aisin Seiki Kabushiki Kaisha, Kariya, Japan

[21] Appl. No.: 507,836

[22] Filed: Jul. 27, 1995

[30] Foreign Application Priority Data

Jul. 27, 1994 [JP] Japan ..... 6-175811

[51] Int. Cl.[6] ..... F04B 43/04

[52] U.S. Cl. ..... 417/322; 417/413.2

[58] Field of Search ..... 417/322, 413.2, 417/413.3

[56] References Cited

U.S. PATENT DOCUMENTS 5,215,446 6/1993 Takahashi et al. ..... 417/322

5,259,737 11/1993 Kamisuki et al. ..... 417/322

5,288,214 2/1994 Fukuda et al. ..... 417/413.3

FOREIGN PATENT DOCUMENTS 2-149778 5/1990 Japan .

*Primary Examiner*—Richard E. Gluck

*Attorney, Agent, or Firm*—Sughrue, Mion, Zinn, Macpeak & Seas

[57] ABSTRACT

A micropump is disclosed including an input port, an output port, a fluid channel space located therebetween, a first oscillating member for opening or closing between the fluid channel space and the input port, a second oscillating member for opening or closing between the fluid channel space and the output port, and at least one third oscillating member for reducing/enlarging the volume of the fluid channel space. The micropump is provided with pressure correcting means which applies a pressure, substantially equal to a fluid pressure at the input port, to a space located outside the fluid channel space and in which the first oscillating member oscillates.

10 Claims, 14 Drawing Sheets

MICROPUMP

FIELD OF THE INVENTION

The invention relates to a so-called micropump having an extremely small discharge flow, in particular, while not intended to be limited thereto, to a micropump which utilizes a small and thin diaphragm such as a bimorph piezoelectric oscillator in its discharge drive.

BACKGROUND OF THE INVENTION

In one form of such micropump, three or more oscillators are disposed along a fluid channel space extending from an input port to an output port and are driven for oscillation so that they are sequentially displaced in phase. A first oscillator is located adjacent to the input port while a second oscillator is located adjacent to the output port, and a third set of oscillators including one or more oscillators are disposed between the first and the second oscillator for reducing/enlarging the fluid channel space. When the second oscillator closes the output port and the first oscillator is driven to open the input port, the third set of oscillators are driven for suction. When the second oscillator is driven in a direction to open the output port while the first oscillator is driven in a direction to close the input port, the third set oscillators are driven for discharge. Subsequently, the described sequence is repeated. By driving the first, the third set of and the second oscillators in a sequential order with a given phase difference therebetween, a fluid can be driven from the input to the output port. One of such micropumps is disclosed in Japanese Laid-Open Patent Application No. 149,778/1990.

In the micropump disclosed in this Laid-Open Application, the first oscillator oscillates in a manner to open or close the connection between the input port and the fluid channel space. However, the drive applied to the oscillator in a direction to close the connection therebetween tends to be low, and whenever a high pressure is applied to the input port, such pressure is effective to force the oscillator open, resulting in a failure to close the channel space and causing a propagation of the high pressure at the input port to the output port. For example, when an input pressure at the input port is subject to a fluctuation, the outcome is that a high pressure appears at the output port for an interval corresponding to the high level of the input pressure, resulting in a fluctuation in the output delivered from the output port. For most applications, it is necessary that the micropump maintains a constant flow rate (or a constant velocity of flow) though the flow rate (the amount of flow per unit time or velocity of flow) is very low. Thus, it is desirable that the constant velocity of flow be maintained despite any fluctuation in the pressure appearing at the input port. By way of example, when a reagent is continuously supplied at a given rate for purpose of a continuous chemical reaction or analysis, when the supply is controlled in terms of a pumping time in order to meter a small quantity, or when a small quantity of liquid medicine is to be administered, by injection, to a patient, a close control over the flow rate being supplied is required. Obviously it is desirable that a micropump be compact, easily assembled, and has reduced variation from product to product.

SUMMARY OF THE INVENTION

It is a first object of the invention to provide a micropump having a reduced fluctuation in the velocity of flow being delivered in response to a fluctuation in an input pressure, and a second object is to provide a micropump which is compact, easily assembled and has reduced variation from product to product.

The invention relates to a micropump including an input port (25), an output port (27), a fluid channel space (22) located between the input port (25) and the output port (27), a first oscillating member (30, 72, 70) for opening or closing a communication between the fluid channel space (22) and the input port (25), a second oscillating member (30, 82, 80) for opening or closing a communication between the fluid channel space (22) and the output port (27) and at least one third oscillating member (10, 92, 90) for reducing/enlarging the fluid channel space (22). In accordance with the invention, pressure correcting means (50, 61, 6.8) which applies a pressure, substantially equal to a fluid pressure at the input port (25), to a space (41) located outside the fluid channel space (22) and in which the first oscillating member (30, 72, 70) oscillates.

In a preferred embodiment of the invention, the micropump comprises an intermediate plate (20) including an input port (25) and an output port (27) spaced apart from each other and extending through the plate in the direction of thickness thereof, a suction opening (24) located adjacent to the input port (25) and extending through the plate in the direction of thickness thereof and a suction valve seat (23) which surrounds the opening, and a discharge opening (29) located adjacent to the output port (27) and extending through the plate in the direction of thickness thereof and a discharge valve seat (28) which surrounds the discharge opening;

- a first oscillating member (30, 72, 70) disposed in a space located on the side of the intermediate plate (20) into which the suction valve seat (23) projects, and including a thin sheet (30) disposed opposite to the input port (25) and the suction valve seat (23), and an oscillator (70) to which the thin sheet (30) is secured;
- a second oscillating member (30, 82, 80) disposed in a space located on the side of the intermediate plate (20) into which the discharge valve seat (28) projects, and including a thin sheet (30) disposed opposite to the output port (27) and the discharge valve seat (28), and an oscillator (80) to which the thin sheet (30) is secured;
- a third oscillating member (10, 92, 90) disposed to face the surface of the intermediate plate (20) which is on the opposite side from the first oscillating member (30, 72, 70), and including a thin sheet (10) for defining a fluid channel space (22) communicating to the suction opening (24) and the discharge opening (29), and an oscillator (90) to which the thin sheet (10) is secured;
- a cover member (40) for defining a space (41) in which the first oscillating member (30, 72, 70) oscillates on the opposite side of the thin sheet (30) of the first oscillating member (30, 72, 70) from the intermediate plate (20);
- and pressure correcting means ( 50, 61, 68 ) for applying a pressure, which is substantially equal to a fluid pressure at the input port (25), to the space (41) in which the first oscillating member (30, 72, 70) oscillates.

In addition, the suction opening (24) has an area of opening which faces the thin sheet (30) of the first oscillating member (30, 72, 70) which is less than the area of the thin sheet (30) which faces the space (41) in which the first oscillating member oscillates. Additionally, stop means (3) is provided for restricting a movement of the third oscillating member (10, 92, 90) in a direction to enlarge the fluid channel space (22).

It is to be understood that in the above description, numerals entered in parentheses represent reference numerals used to designate corresponding elements appearing in an embodiment to be described later for the convenience of reference.

With the micropump of the invention, when the second oscillating member (30, 82, 80) closes the communication between the output port (27) and the fluid channel space (22) and the first oscillating member (30, 72, 70) opens the communication between the input port (25) and the fluid channel space (22), the third oscillating member (10, 92, 90) is driven for suction or so as to enlarge the volume of the fluid channel space (22). Subsequently, the second oscillating member (30, 82, 80) is driven in a direction to open the communication between the output port (27) and the fluid channel space (22) and the first oscillating member (30, 72, 70) is driven in a direction to close the communication between the input port (25) and the fluid channel space (22), and the third oscillating member (10, 92, 90) is driven for discharge or so as to reduce the volume of the fluid channel space (22). Subsequently, the described process is repeated. In this manner, by driving the first oscillating member (30, 72, 70), the third oscillating member (10, 92, 90) and the second oscillating member (30, 82, 80) in a sequential order with a given phase difference therebetween, the fluid can be driven from the input port (25) to the output port (27).

The pressure correcting means (50, 61, 68) applies a pressure which is substantially equal to a fluid pressure at the input port (25) (hereafter such pressure is simply referred to as an input port pressure) to the space (41) located outside the fluid channel space (22) and in which the first oscillating member (30, 72, 70) oscillates. Accordingly, a region adjacent to the space (41) of the first oscillating member (30, 72, 70) is always subject to the input port pressure, and such input port pressure adds to the drive which is applied to the first oscillating member (30, 72, 70) to close the communication between the input port (25) and the fluid channel space (22) when such oscillating member tends to close such communication. Hence, if a fluctuation occurs in the pressure at the input port (25) and is accidentally applied to the first oscillating member (30, 72, 70) in a direction to open the communication, it will be cancelled out, preventing the first oscillating member (30, 72, 70) to open the communication between the input port (25) and the fluid channel space (22). In other words, there occurs no fluctuation in the output port pressure or in the output flow rate in response to a fluctuation ill the input port pressure.

In a preferred embodiment of the invention, the suction opening (24) has an area of opening which faces the thin sheet (30) of the first oscillating member (30, 72, 70) which is less than the area of the thin sheet (30) which faces the space (41) in which the first oscillating member oscillates. Accordingly, if a pressure rises in the fluid channel space (22) in response to a discharge operation, the thin sheet (30) of the first oscillating member (30, 72, 70) cannot be driven by such pressure in a direction away from the suction opening (24), thus preventing a reverse flow of the fluid from the fluid channel space (22) through the suction opening (24) to the input port (25).

Stop means (3) is provided for restricting a movement of the third oscillating member (10, 92, 90) in a direction to enlarge the volume of the fluid channel space (22). This limits the suction stroke of the third oscillating member, thus providing a constant discharge from the pump in an accurate manner.

Finally, the thin sheet (30) of the first oscillating member (30, 72, 70) and the thin sheet (10) of the third oscillating member (10, 92, 90) are disposed on the front and the back side of the intermediate plate (20) in which the input port (25), the suction opening (24), the suction valve seat (23), the output port (27) the suction opening (29) and the discharge valve seat (28) are formed. The intermediate plate (20) can be formed as by a photoetching technique of Si plate, for example, which enables a fine working. Accordingly, a compact pump as a whole is obtained, which is easily assembled, and which has a reduced variation in the pumping response from product to product.

Other objects and features of the invention will become apparent from the following description of an embodiment thereof with reference to the drawings.

DESCRIPTION OF PREFERRED EMBODIMENT

Figure 1:
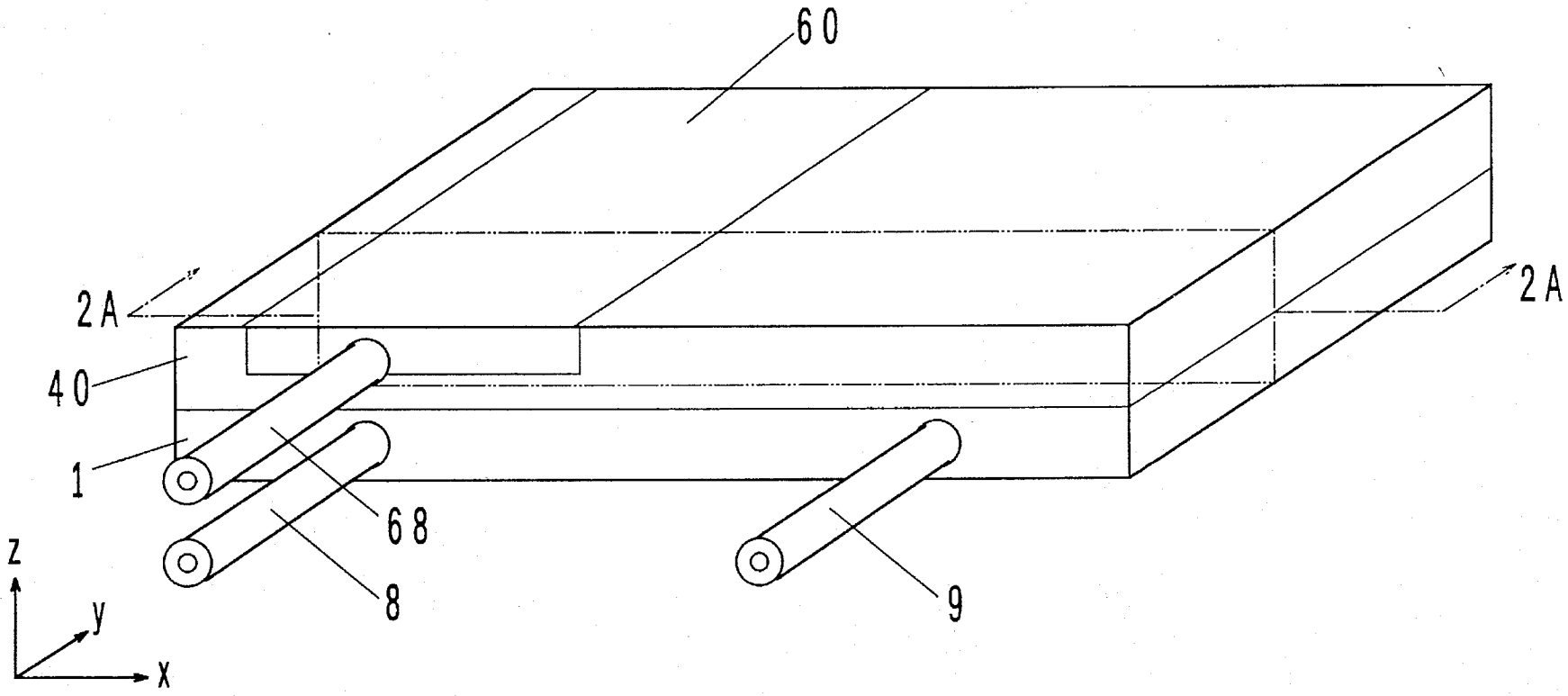
FIG. 1 is a perspective view illustrating the appearance of one embodiment of the invention.

A micropump according to the invention is illustrated in FIG. 1, and is rectangular in configuration having a width (in the x direction) of 30 mm, a length (in the y direction) of 26 mm, and a thickness (in the z direction) of 6.4 mm. A suction pipe 8, a discharge pipe 9 and a correcting pressure pipe 68 projects from the rectangular body. The micropump includes a number of components which has a very small thickness in the z direction and thus are in the form of sheets. Since their thickness cannot be easily illustrated in the drawings, a magnification of 10/3 is used in the z direction as compared with the x and y directions in FIG. 2 which is a cross section taken along the line 2A—2A shown in FIG. 1 as phantom lines. The similar magnification of 10/3 in the z direction in relation to the x and y directions is applied also in FIGS. 5 to 7 and FIGS. 12 to 15.

Figure 2:
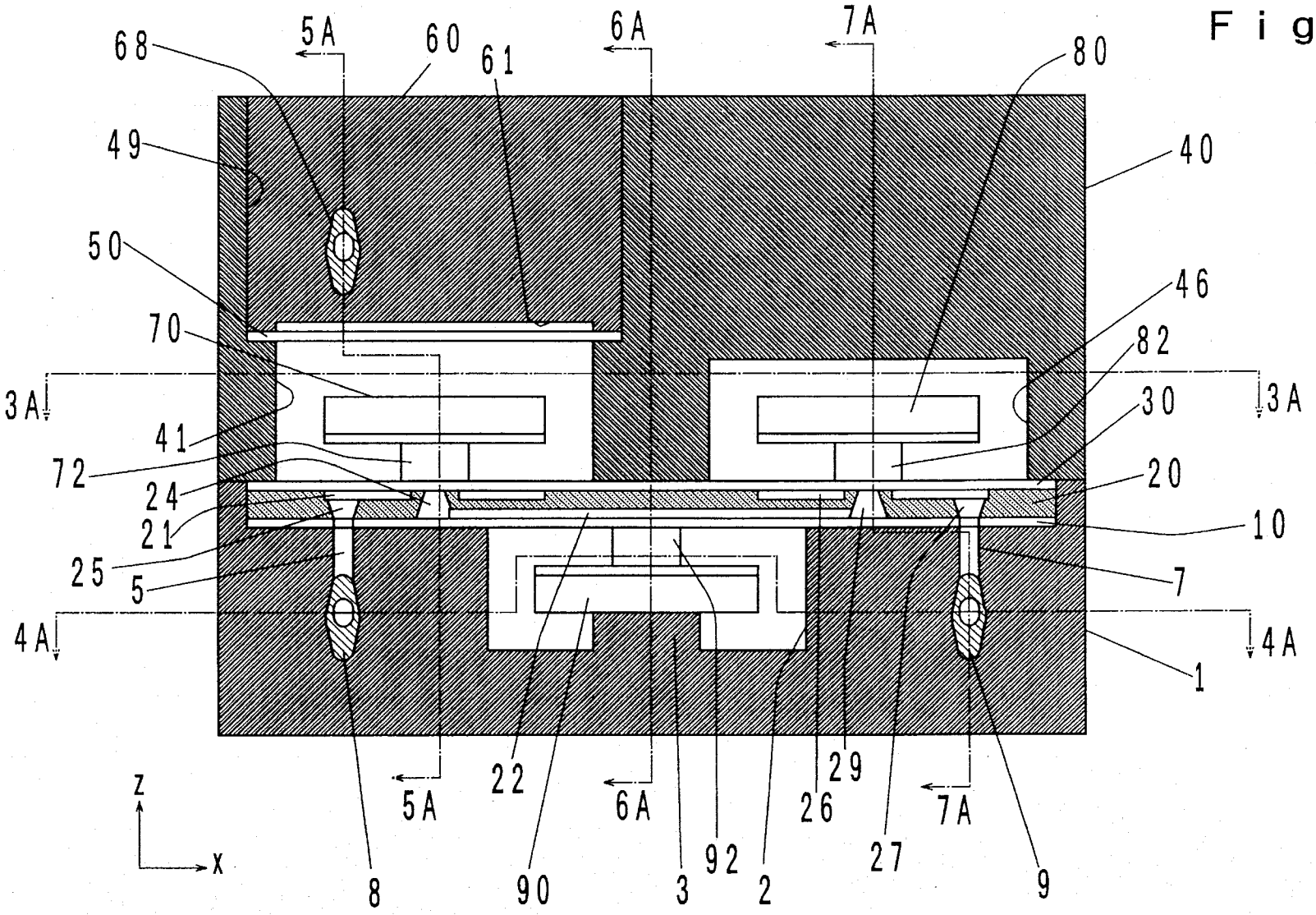
FIG. 2 is a cross section taken along the line 2A—2A shown in FIG. 1, it being noted that a magnification of 10/3 is applied in the z direction with reference to the x and y directions.

Referring to FIGS. 1 and 2, a thin glass plate 10 is cemented to the bottom surface of a Si thin sheet 20, representing an intermediate plate, while a thin glass sheet 30 is cemented to the upper surface thereof. A base plate 1, formed of synthetic resin, has a square-shaped shallow opening formed in its upper surface in which the Si plate 20 is inserted, and the glass sheet 10 is cemented to the bottom surface of the shallow opening in the base plate 1. A top plate 40, also formed of synthetic resin, is cemented to the upper surfaces of the base plate 1 and the glass sheet 30, whereby the base plate 1, the glass sheet 10, Si sheet 20, the glass sheet 30 and the top plate 40 are integrally connected together.

Figure 4:
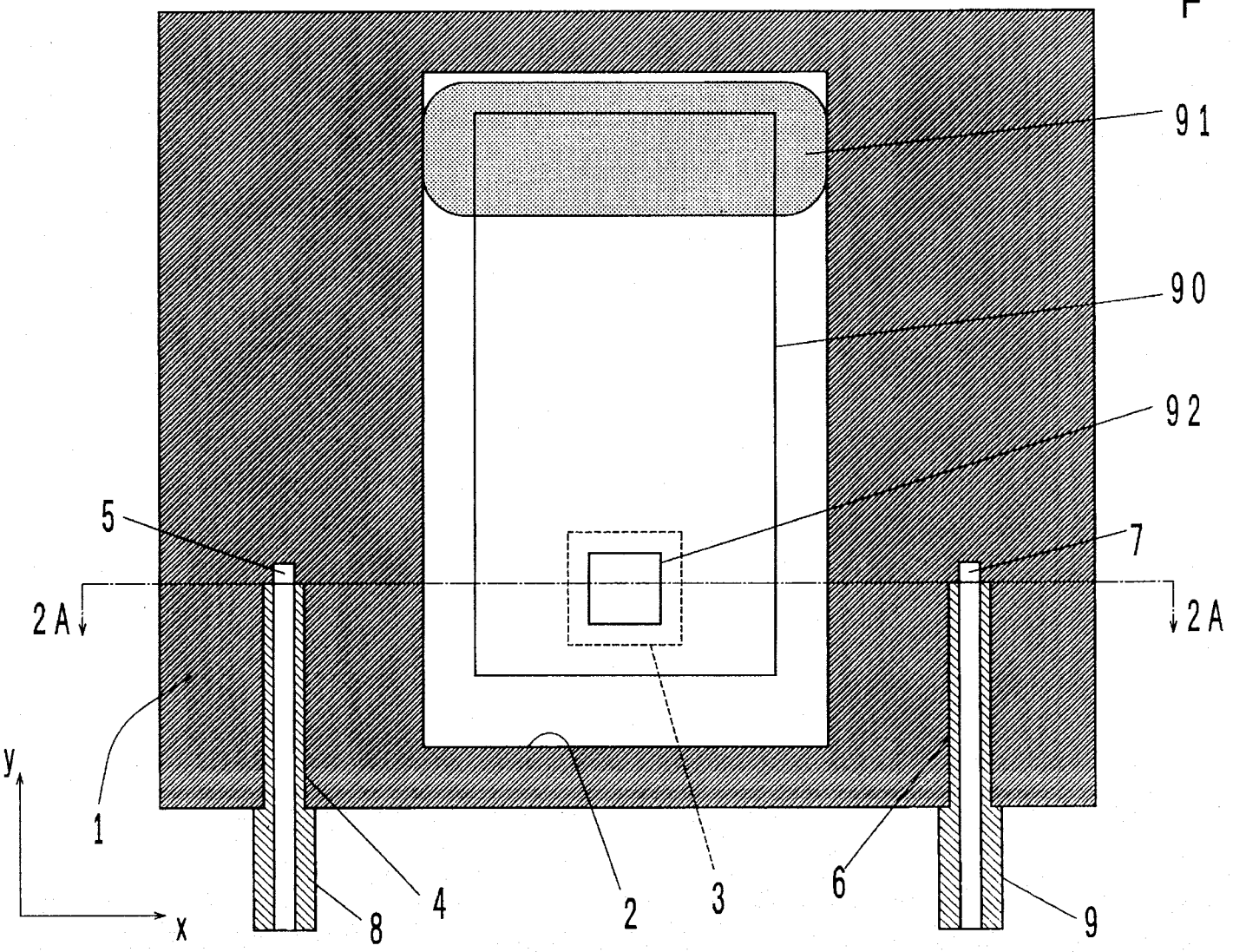
FIG. 4 is a cross section taken along the line 4A—4A shown in FIG. 2.
Figure 6:
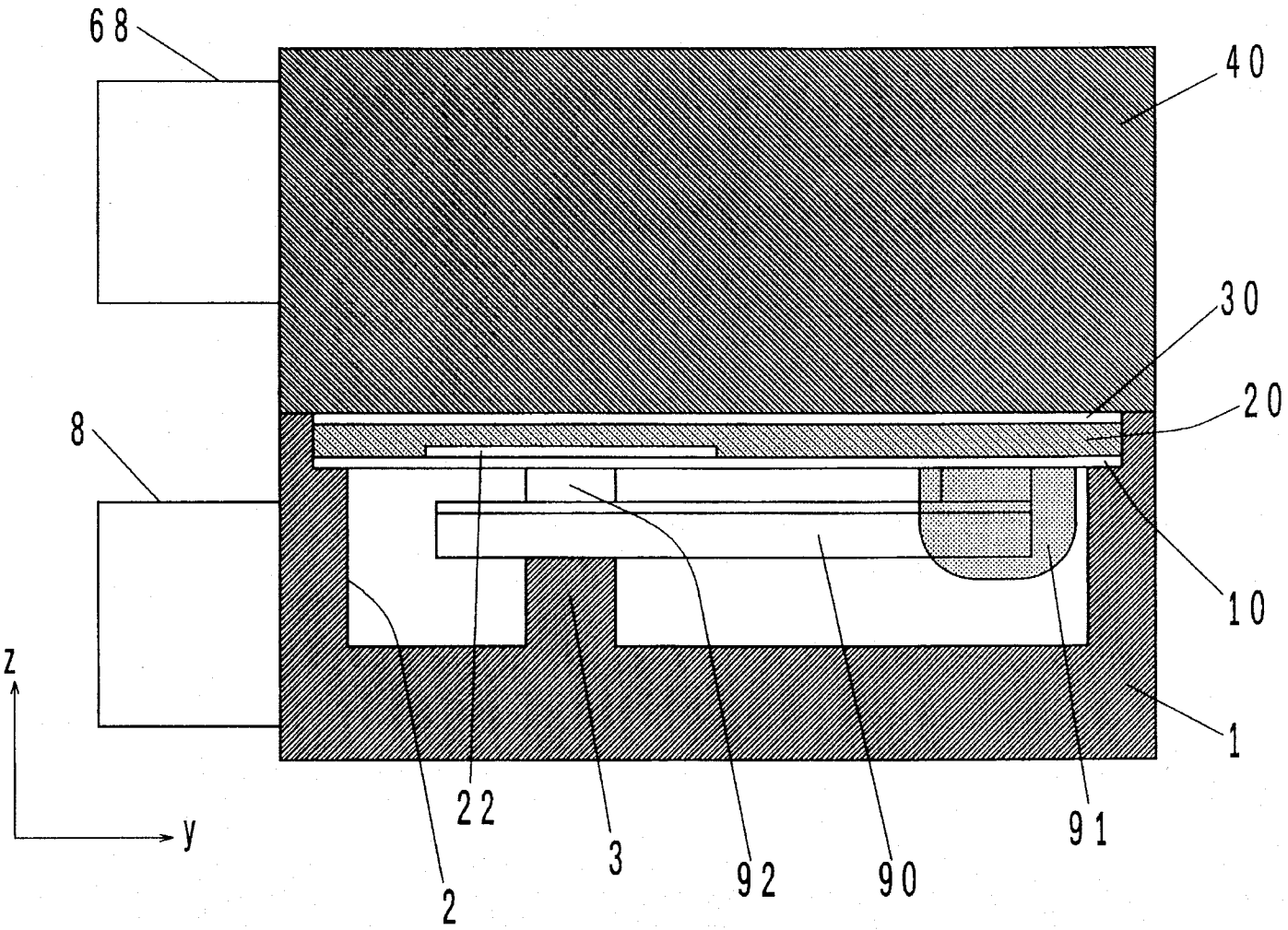
FIG. 6 is a cross section taken along the line 6A—6A shown in FIG. 2, it being noted that a magnification of 10/3 is applied in the z direction with reference to the x and y directions.

As shown in FIGS. 2, 4 and 6, a square opening 2 of a smaller area that the shallow square opening formed. in the upper surface of the base plate 1 continues from the shallow opening, and a stop 3 projects through the bottom surface of the opening 2. A bimorph piezoelectric diaphragm or oscillator 90 is contained in the opening 2, and has its one end secured to the bottom surface of the glass sheet 10 by an adhesive 91 (see FIGS. 4 and 6). The other end or free end of the diaphragm 90 is secured to the bottom surface of the glass sheet 10 through a spacer 92 (see FIGS. 4 and 6) interposed therebetween. The stop 3 and the spacer 92 are vertically aligned as viewed in a plane defined by x and y coordinates, and are spaced apart in the z direction. Pipe openings 4 and 6, and an input port passage 5 and an output port passage 7 (see FIGS. 2 and 4) which continue therefrom are formed in the base plate 1 so as to extend in the y direction and a suction pipe 8 and a discharge pipe 9 are a press fit into the pipe openings 4 and 6, respectively. The suction pipe 8 communicates with the input port passage 5, and the discharge pipe 9 communicates with the output port passage 7.

Figure 11:
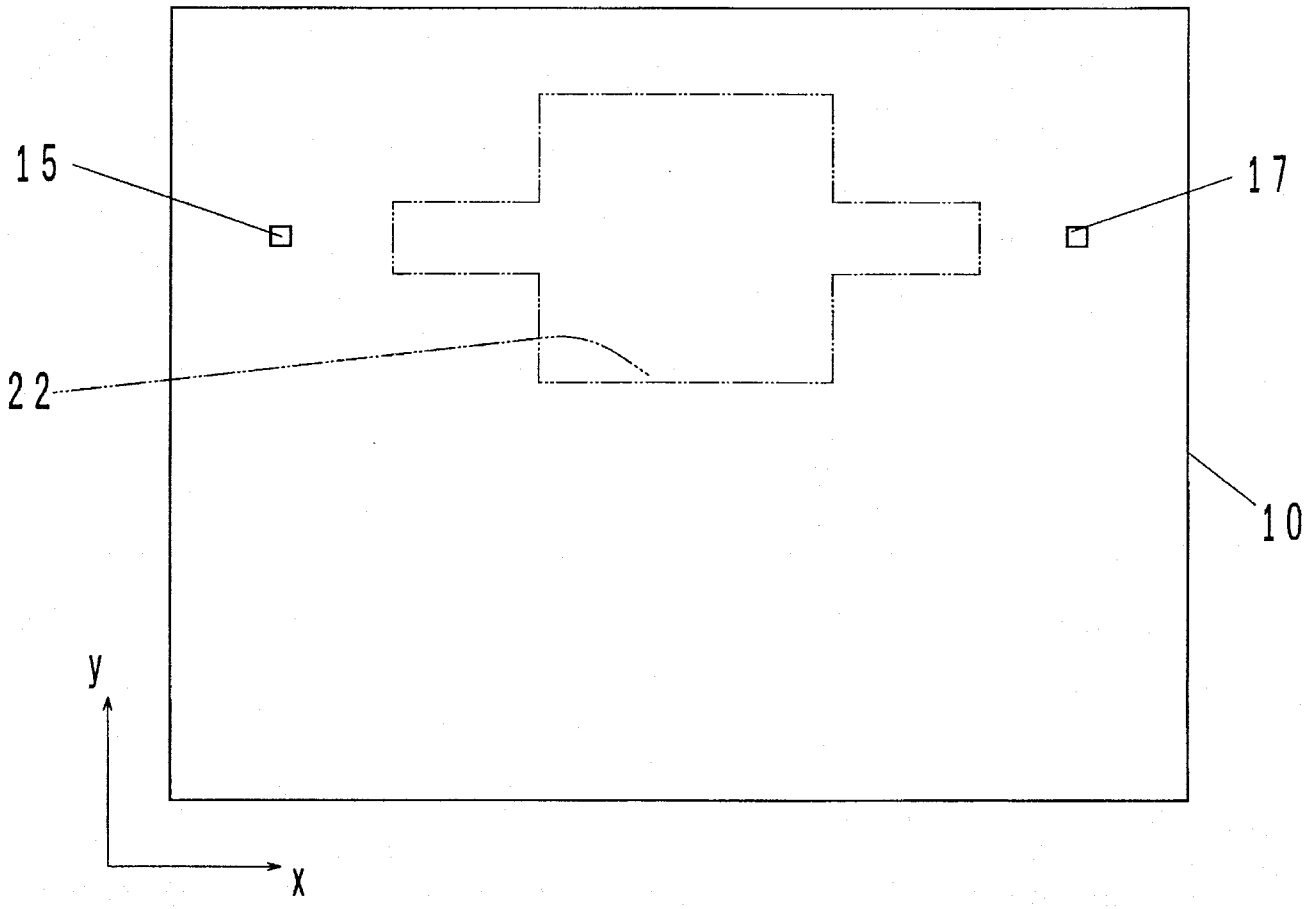
FIG. 11 is a plan view, showing the bottom surface of a thin glass sheet 10 shown in FIG. 2.

Referring to FIG. 11 which shows the bottom surface of the lower glass sheet 10, the sheet 10 is formed with through-openings 15 and 17, which are aligned with the input port passage 5 and the output port passage 7, respectively.

Figure 9:
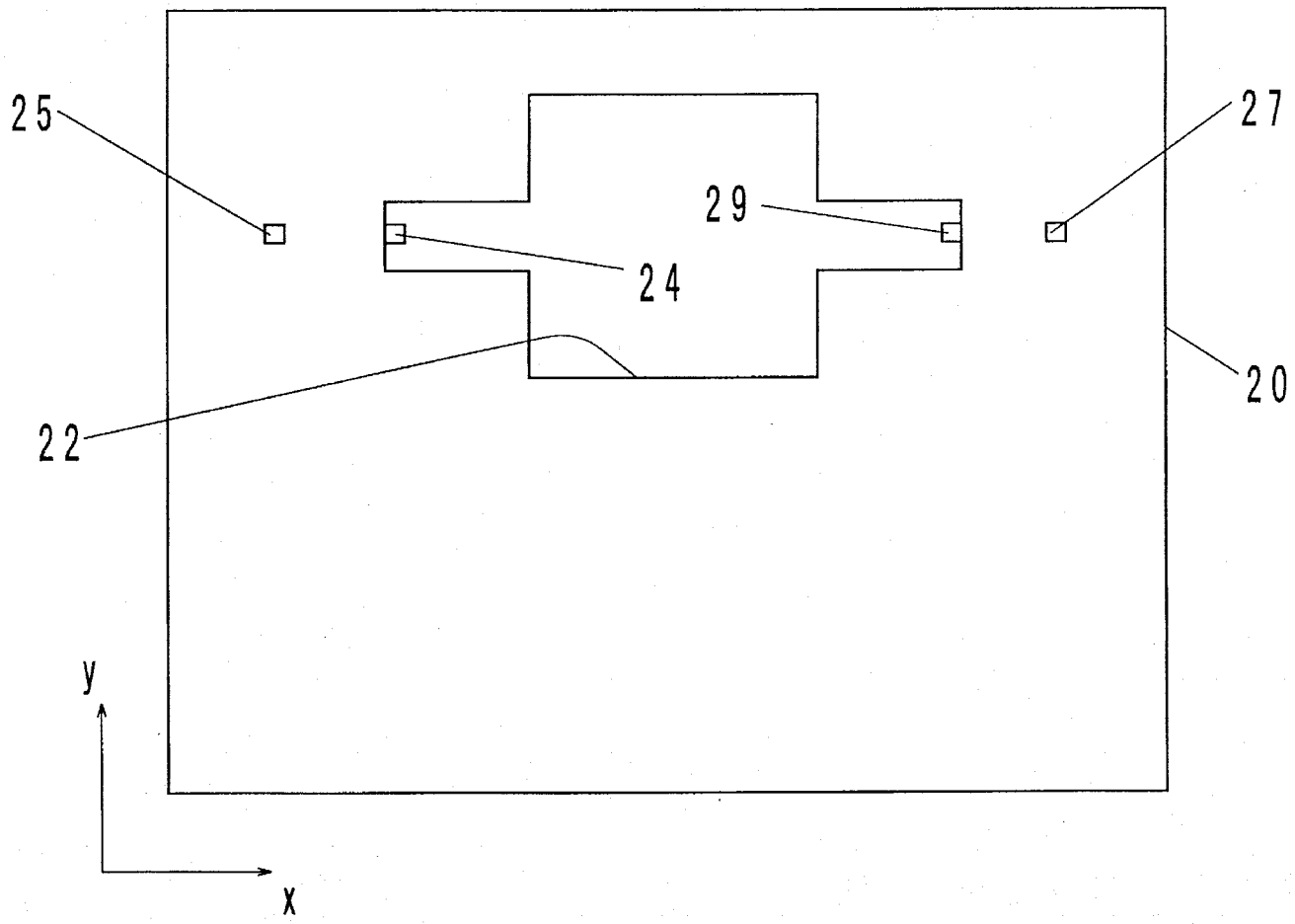
FIG. 9 is a plan view, showing the lower surface of the Si sheet 20 shown in FIG. 2.

Referring to FIG. 9 which shows the bottom surface of the Si sheet 20 an opening 22 having a closed bottom and including rectangular projections which project in the x direction from the central square is formed in the bottom surface of the Si sheet 20 to function as a fluid channel space. The center position of the fluid channel space as represented in the x and y coordinates is aligned with the center position of the spacer 92 (FIGS. 4 and 6). An input port (opening) 25 and an output port (opening) 27 of a miniature size extend through the Si sheet 20 in the direction of the thickness thereof, and the input port 25 is aligned with the openings 25 in the glass sheet 10 while the output port 27 is aligned with the opening 17 in the glass sheet 10 in this manner, the input port 25 communicates with the suction pipe 8 while the output port 27 communicates with the discharge pipe 9. In addition, the Si sheet 20 is formed with a suction opening 24 and a discharge opening 29, which are located at the ends of the rectangular projections from the opening 22, these openings extending through the thickness of the Si sheet 20.

Figure 8:
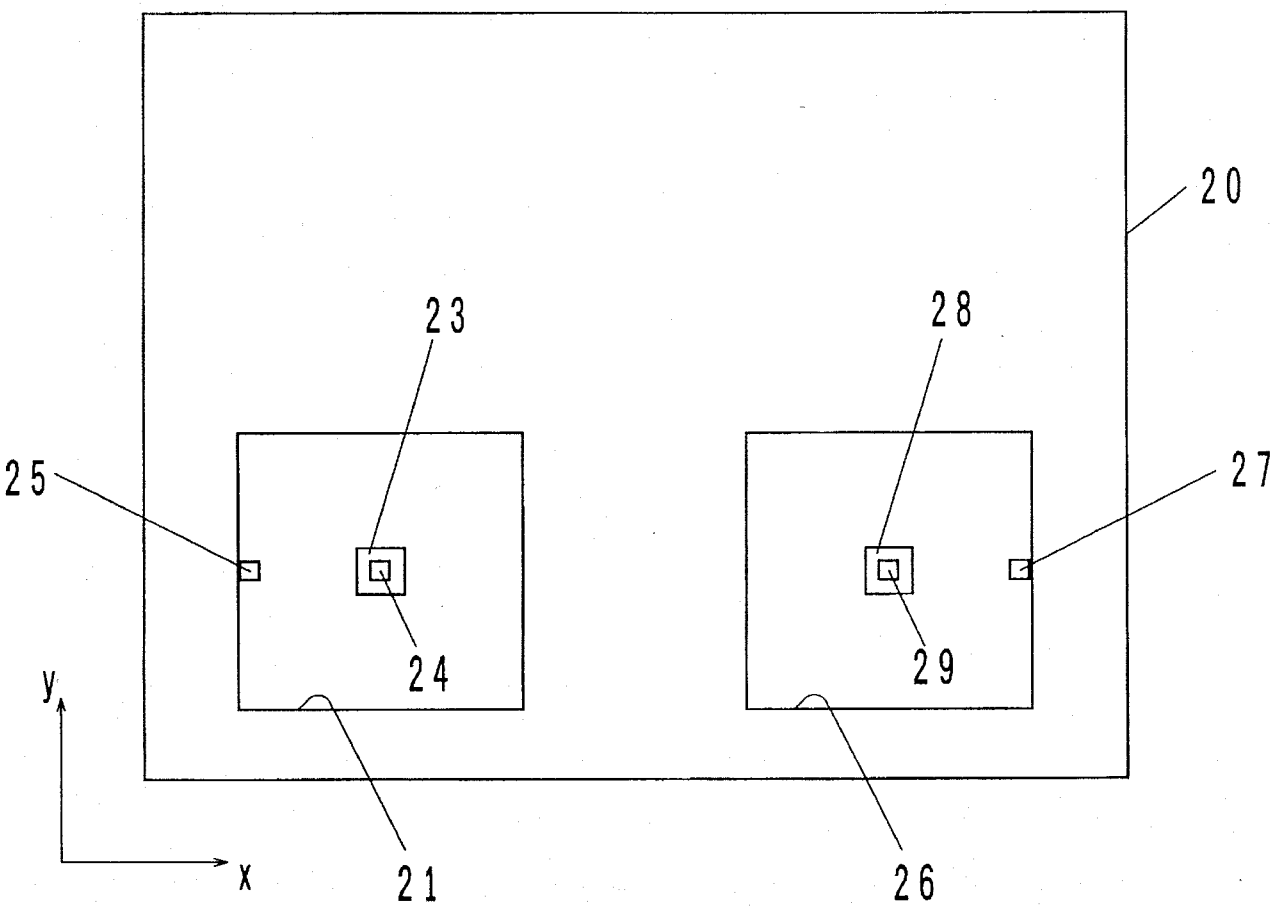
FIG. 8 is a plan view, showing the upper surface of Si thin sheet 20 shown in FIG. 2.

Referring to FIG. 8 which shows the upper surface of the Si sheet 20, a square opening 21 having a closed end and centered about the suction openings 24 and into which the input port 25 opens is formed in the upper surface of the Si sheet 20 to function as an input port communicating space. Similarly, a square opening 26 having a closed bottom and which is centered about the discharge opening 29 and into which the output port 27 opens is formed to function as an output port communicating space. It is to be noted that a small region around the suction opening 24 is excluded from the opening 21, and the upper surface of the Si sheet 20 remains intact in such region, which defines a suction valve seat 23. Similarly, a small region around the discharge opening 29 is excluded from the opening 26, and the upper surface of the Si sheet 20 remains intact in such region, which defines a discharge valve seat 28.

It is to be noted that the opening 22 having a closed bottom, through-openings 25,27,24 and 29 and openings 21 and 26 each having a closed bottom are formed in the Si sheet 20 by a known masking and etching technique.

Figure 10:
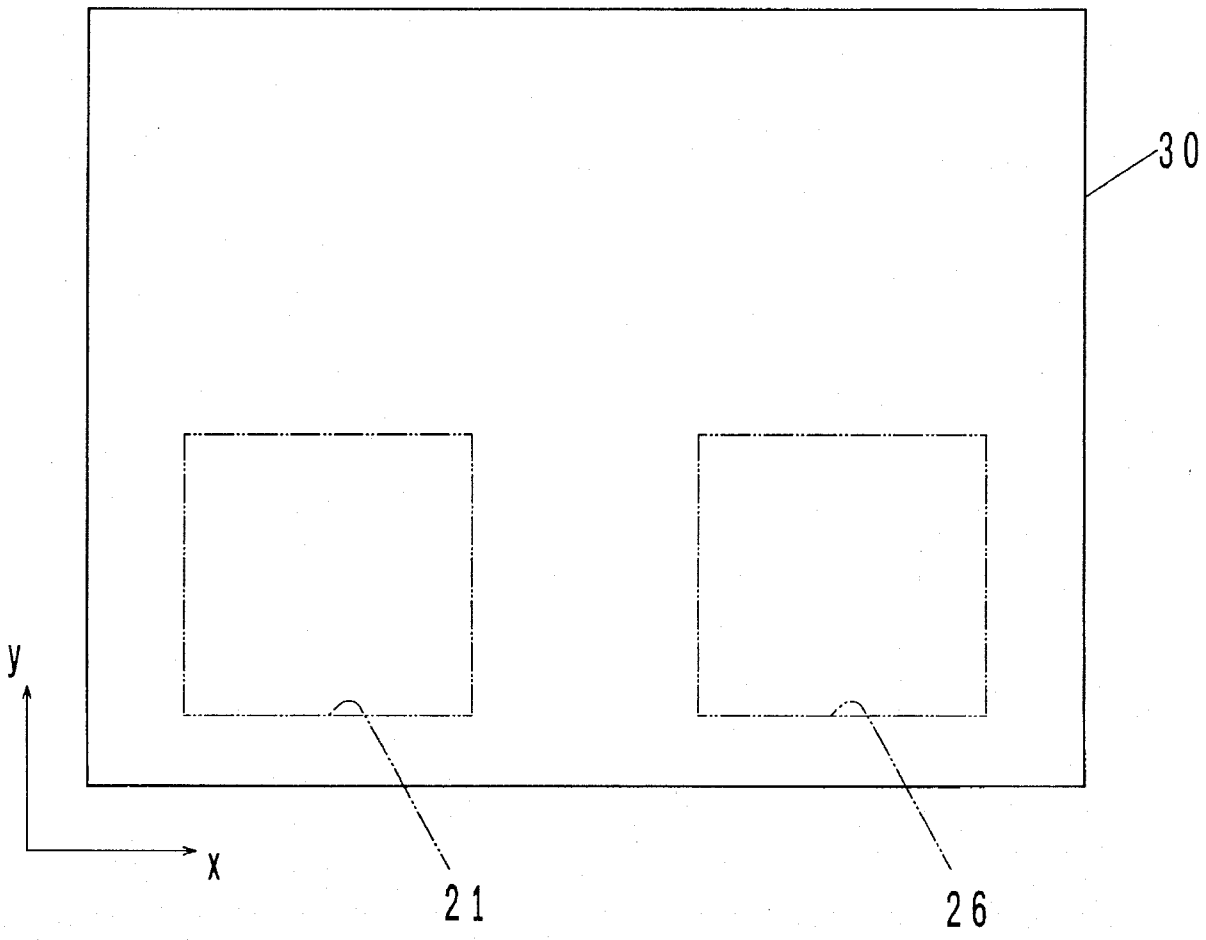
FIG. 10 is a plan view, showing the upper surface of a thin glass sheet 30 shown in FIG. 2.

The bottom surface of the upper glass sheet 30 is generally cemented to the upper surface of the Si sheet 20, but does not abut against the suction valve seat 23 and the discharge valve seat 28, and accordingly, the glass sheet 30 is capable of moving (or oscillating) in the z direction relative to the suction valve seat 23 and the discharge valve seat 28. The upper surface of the upper glass sheet 30 is illustrated in FIG. 10.

Figure 3:
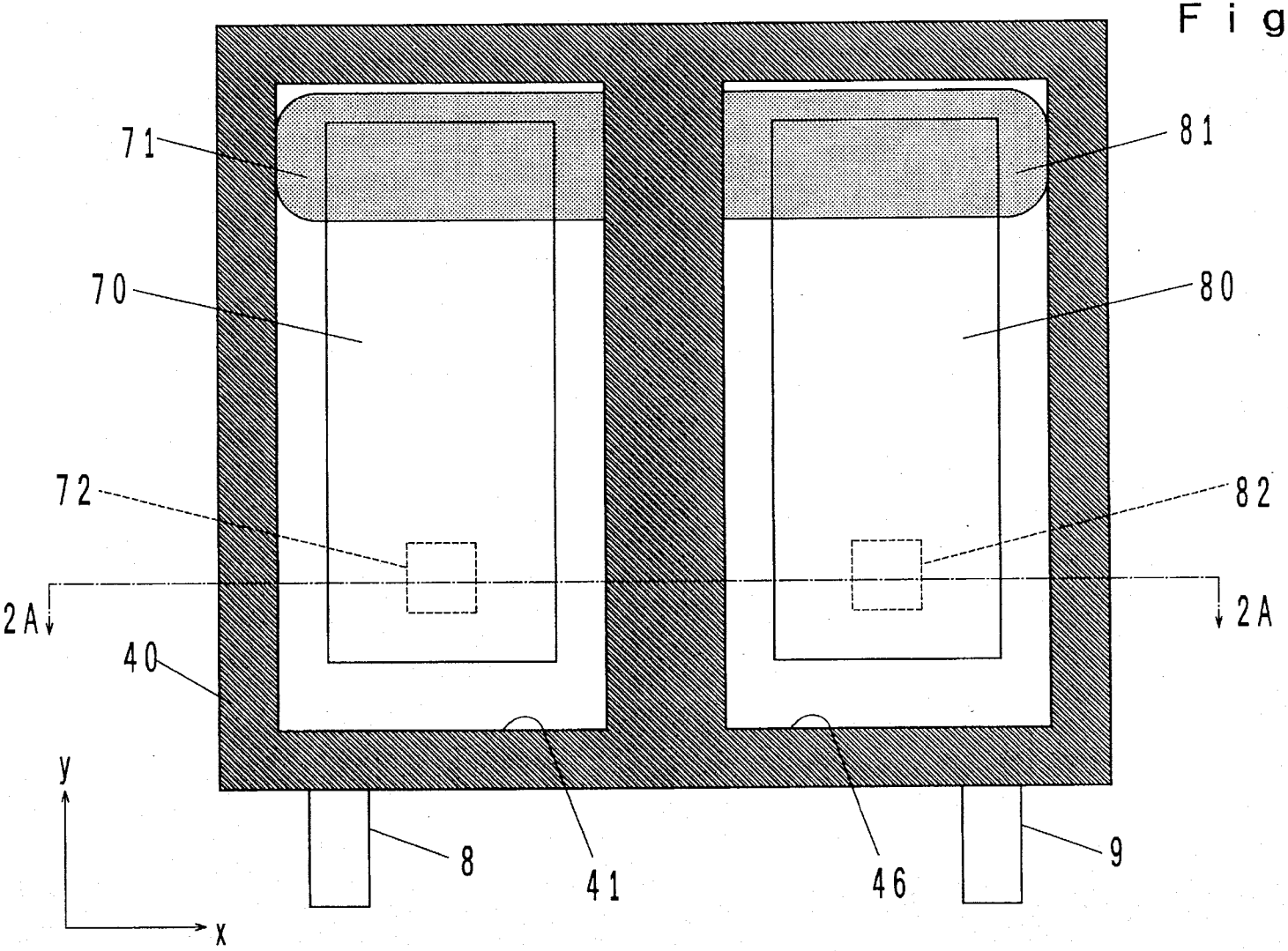
FIG. 3 is a cross section taken along the line 3A—3A shown in FIG. 2.

Referring to FIGS. 2 and. 3, a pair of openings 4i and 4.2 are formed in the bottom surface of the top plate 40, each containing one of bimorph piezoelectric diaphragms 70 and 80. One end of the diaphragm 70 is secured to the upper surface of the glass sheet 30 by an adhesive 71 (see FIGS. 3 and 5), while the other end or free end of the diaphragm 70 is secured to the upper surface of the glass sheet 30 through a spacer 72 (FIGS. 3 and 5) interposed therebetween. The spacer 72 is aligned with the suction opening 24 as considered in a plane defined by the x and y coordinates, but are spaced apart in the z direction. One end of the diaphragm 80 is secured to the upper surface of the glass sheet 30 by an adhesive 81 (FIGS. 3 and 7) while the other end or the free end of the diaphragm 80 is secured to the upper surface of the glass sheet 30 through a spacer 82 (FIGS. 3.and 7) interposed therebetween. The spacer 82 is aligned with the discharge opening 29 as viewed in the plane defined by the x and y coordinates, but are spaced apart in the z direction.

Figure 5:
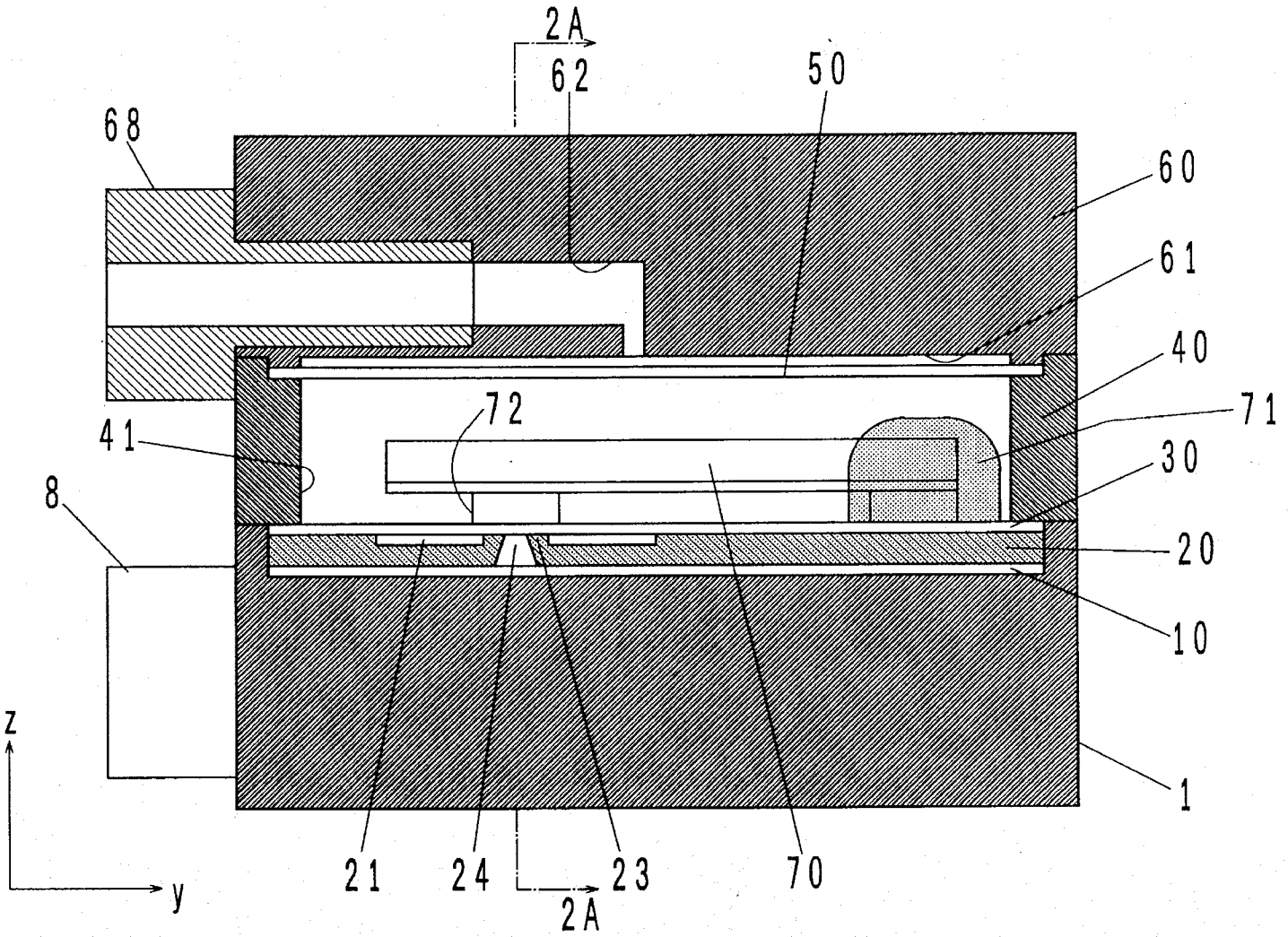
FIG. 5 is a cross section taken along the line 5A—5A shown in FIG. 2, it being noted that a magnification of 10/3 is applied in the z direction with reference to the x and y directions.
Figure 7:
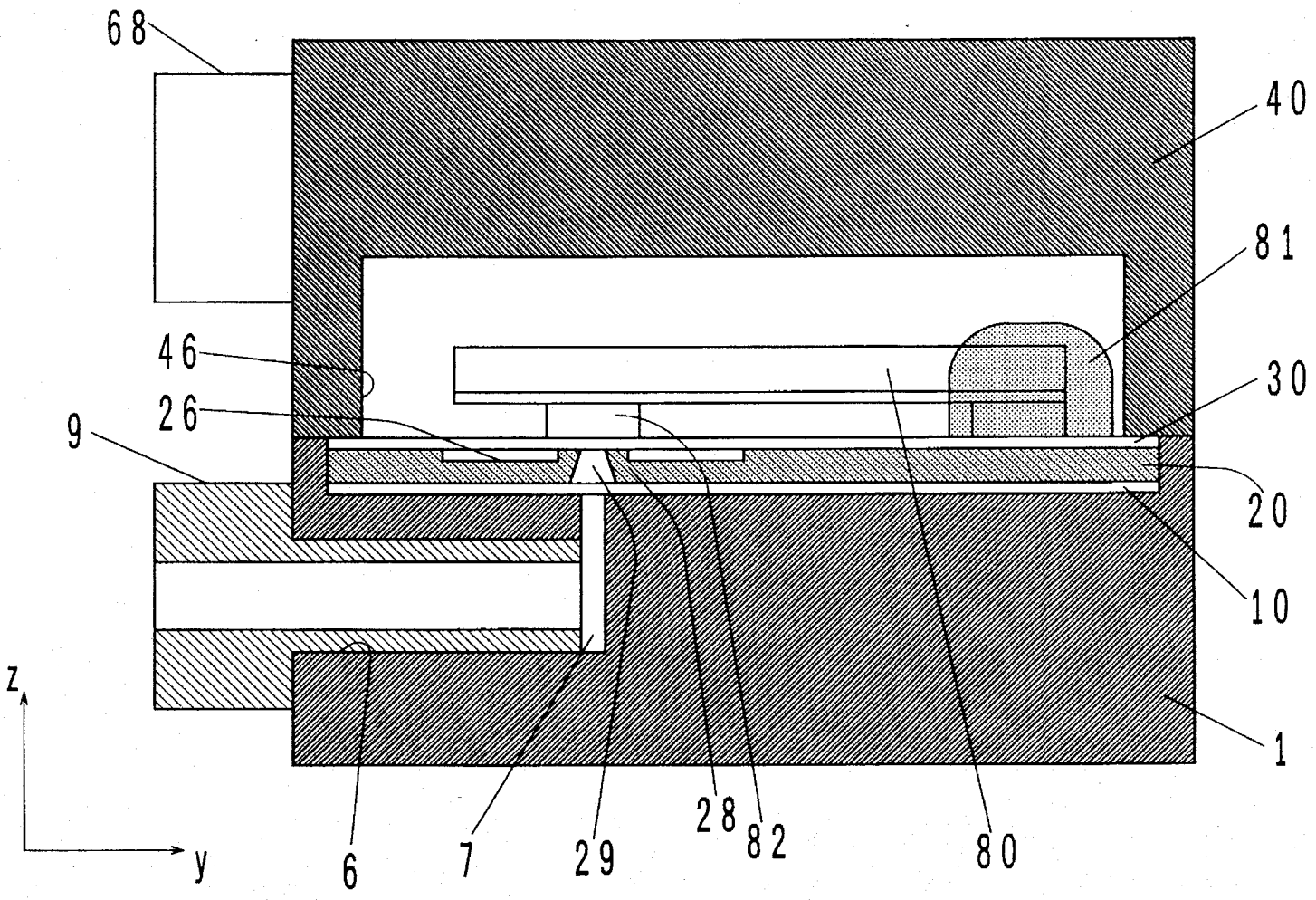
FIG. 7 is a cross section taken along the line 7A—7A shown in FIG. 2, it being noted that a magnification of 10/3 is applied in the z direction with reference to the x and y directions.

As shown in FIGS. 2 and 7, an opening 46 formed in the top plate 40 has a closed bottom, but the opening 41 continues to a larger opening 49 (see FIG. 2.) which extends to the upper surface of the top plate 40. Bellows 50 having a small spring constant is secured to the bottom of the opening 49 or at the boundary thereof with the opening 41, and isolates between the openings 41 and 49. A lid 60 formed of synthetic resin and having an opening 61 with the closed bottom (see FIGS. 2 and 5) formed in its bottom surface is inserted into the opening 49, and is adhesively coupled to the inner wall surface of the opening 49. As shown in FIG. 5, the lid 60 is formed with a communication opening 62 which extends in the y direction, and which communicates with the opening 61. The communication opening 62 includes a portion of an increased diameter into which a correcting pressure tube 68 is a press fit, the tube 68 communicating with the internal space of the opening 61 through the communication opening 62.

Electric leads (not shown) are connected to the electrodes of the bimorph piezoelectric diaphragms 70, 80 and 90 at locations where the adhesives 71, 81 and 91 are applied, and these electric leads are taken out of the pump through small holes (not shown) formed in the top plate 40 or the base plate 1, with the space between the leads and the holes being hermetically sealed by an adhesive. These leads are connected through a connector to a pump drive electric circuit (not shown), which is used to apply a sinusoidal or pulse voltages (hereafter referred to as drive voltages) to the diaphragms 70, 90 and 80, the voltages being phase displaced in the sequence named.

Figure 12:
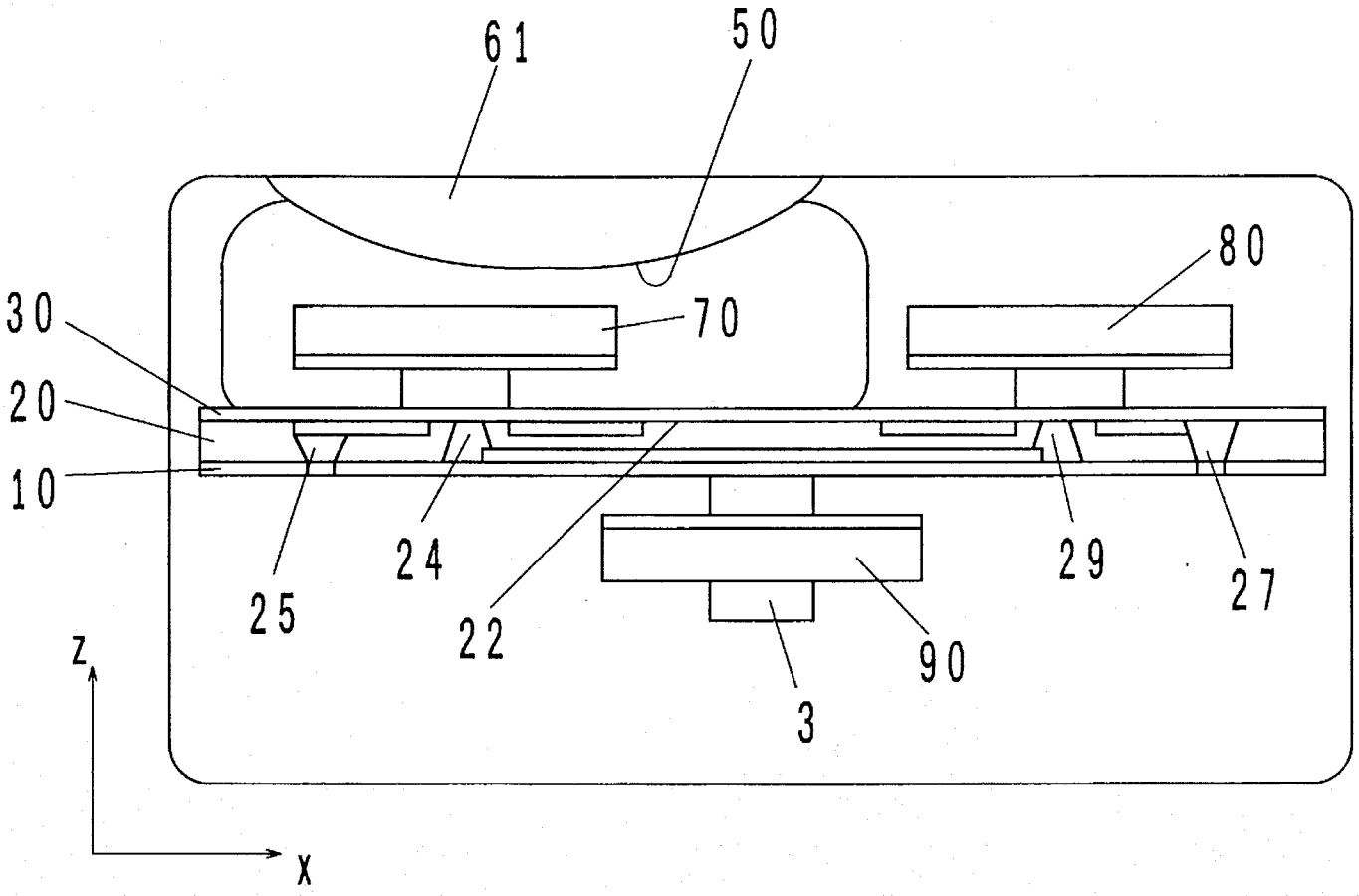
FIG. 12 is a schematic section corresponding to FIG. 2, illustrating the pump at rest.
Figure 13:
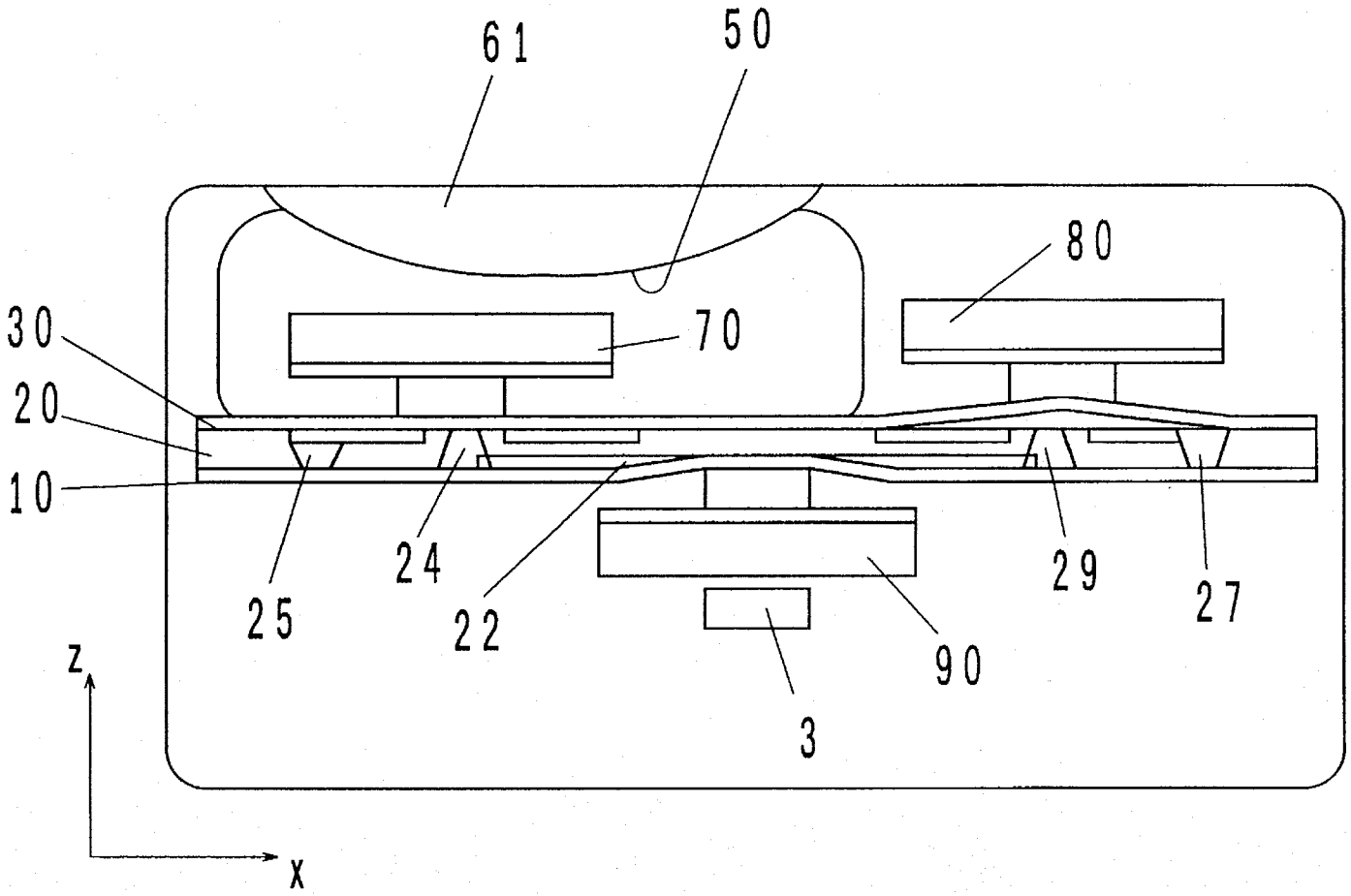
FIG. 13 is a schematic cross section corresponding to FIG. 2, illustrating the pump during one phase of its operation.
Figure 14:
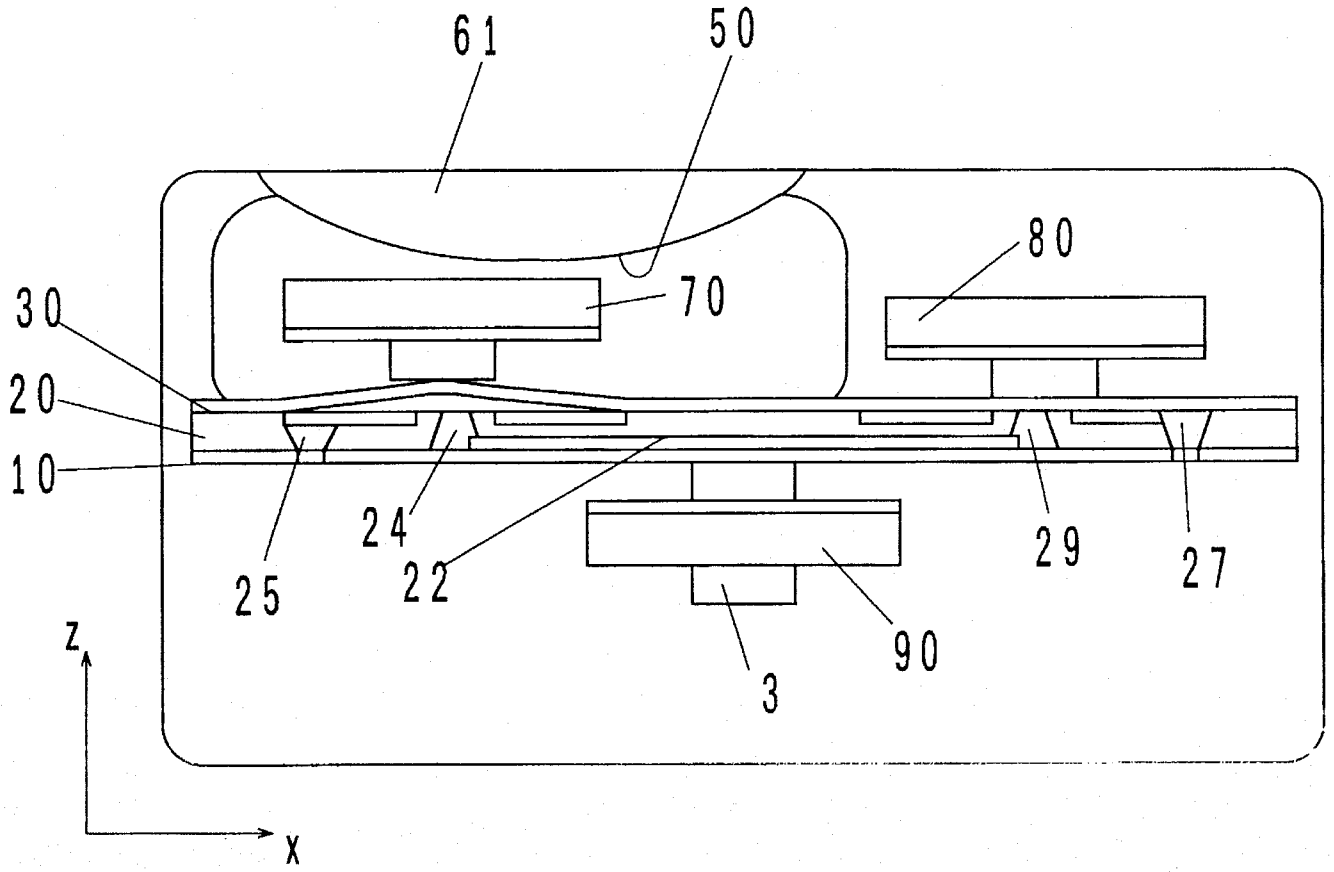
FIG. 14 is a schematic cross section corresponding to FIG. 2, illustrating the pump during another phase of its drive.

The use of the micropump according to the invention for withdrawing a liquid medicine from a source (not shown) and for discharging it will be described. The suction pipe 8 and the correcting pressure tube 68 are connected to the source of liquid medicine. A single forked tube or forked branch tube is used to connect one of the branches to the suction pipe 8 while the other branch is connected to the pressure tube 68, with the other end of the forked tube being connected to the source. FIGS. 12 to 14 are simplified cross sections (corresponding to FIG. 2) which illustrate the pumping operation.

As shown in FIG. 12, when the pump is at rest, no drive voltage is applied to the diaphragms 70, 90 and 80, which therefore maintain their original form, as determined when the pump is manufactured. The first bimorph piezoelectric diaphragm 70 and the second bimorph piezoelectric diaphragm 80 press the sheet 30 against the valve seats 23 and 28, respectively, while the third bimorph piezoelectric diaphragm 90 presses against the stop 3. When the drive circuit applies drive voltages which are phase displaced in a sequential order of the diaphragms 70, 90 and 80, the following steps (1) to (4) are repeated, withdrawing the liquid medicine through the suction pipe 8 and discharging it through the discharge pipe 9.

(1) During a first time interval when the first diaphragm 70 presses the glass sheet 30 to close the suction opening 24, the second diaphragm 80 is moved in a direction to open the discharge opening 29 and simultaneously the third diaphragm 90 is moved in a direction to reduce the volume of the fluid channel space (22) or the space defined by the opening 22 and the glass sheet 10, whereby the liquid medicine in the fluid channel space (22) flows into the space defined by the opening 26 and the sheet 30, or the discharge space (26) (FIG. 13).

(2) During a second time interval, while the third diaphragm 90 has reduced the volume of the fluid channel space (22), the first diaphragm 70 pulls up the glass sheet 30 away from the suction opening 24 and the second diaphragm 80 presses against the glass sheet 30 to close the discharge opening 29. During this process, the liquid medicine is withdrawn through the input port 25 into the space defined by the opening 21 and the sheet 30 or the suction space (21), and the liquid pressure is discharged through the output port 27 from the discharge space (26) defined by the opening 26 and the sheet 30.

(3) During a third time interval, when the first diaphragm 70 opens the suction opening 24 and the second diaphragm 80 closes the discharge opening 29, the third diaphragm 20 moves in a direction to enlarge the volume of the fluid channel space (22) defined by the opening 22 and the glass sheet 10 (FIG. 14). During this process, the liquid pressure in the suction space (21) is withdrawn into the fluid channel space (22).

(4) During a fourth time interval, the first diaphragm 70 closes a suction opening 24 (FIG. 12).

When a fluctuation occurs in the source of liquid medicine or the forked tube which connects it with the pump, the liquid pressure at the input port 25 is subject to a fluctuation.

In the event there occurs a fluctuation in the liquid pressure in the source of liquid medicine or in the forked tube which connects it with the pump, the liquid pressure at the input port 25 is subject to fluctuation. Assuming that the pressure in the suction space (21) rises as a result of an increased liquid pressure level at the input port 25 during the time the pump is at rest (FIG. 12), causing the sheet 30 to be raised to open the suction opening 24, the high pressure will be propagated into the fluid channel space (22) and applied to the discharge opening 29 to be leaked into the discharge space (26) and thence into the discharge pipe 9 through the output port 27. Thus, an unintended outflow of liquid medicine would occur. However, in the described embodiment, the liquid pressure applied to the input port 25 will be applied to the correcting pressure space (61) defined by the opening 61 and the bellows 50 through the correcting pressure tube 68 and the communication opening 62, so that whenever the liquid pressure applied to the input port 25 is high, the bellows 50 bulge to reduce the internal space of the opening 41 in which the diaphragm 70 is contained, thereby increasing the pressure in this internal space. The pressure in this internal space acts upon the upper surface of the sheet 30 in a direction to close the suction opening 24, and thus opposes the pressure acting from the suction opening 24 upon the bottom surface of the sheet 30 to open the suction opening 24, thus suppressing any movement in a direction to open the suction opening 24 in the sheet 30 which may be caused by a fluctuation in the input pressure. This prevents any outflow (leakage) of liquid medicine through the discharge pipe 9 in the presence of a fluctuation in the liquid pressure applied to the suction pipe 8 during the time when the pump is at rest. When the pump is being driven by repeating the steps (1) to (4), any pressure excursion resulting from a fluctuation in the input pressure during the time the diaphragm 70 closes the suction opening 24 cannot open the suction opening 24, thus minimizing a fluctuation which would occur in the discharge flow rate as may be caused by a fluctuation in the input pressure.

In the described embodiment, the correction pressure tube 68, which is separate from the suction pipe 8 is employed. However, the correction pressure tube 68 and the communication opening 62 may be eliminated, and instead flow paths may be formed in the base plate 1, the top plate 40 and the lid 60 for communication with the suction pipe 8 through the opening 61. Depending on the application, the provision of the bellows 50 may be avoided.

In the described embodiment, the base plate 1, the top plate 40 and the lid 60 are formed of synthetic resin, but they may be formed of glass, metal or Si. The intermediate plate formed by thin Si sheet 20 may comprise an injection molding from synthetic resin or machined product depending on the application. In addition, it may comprise glass or metal which is subject to an etching or mechanical machining step. Glass sheets 10 and 30 can be replaced by synthetic resin sheets or Si sheets or thin metal sheets or metal foils. Diaphragms 70, 80 and 90 may each comprise a bimetal or shape memory member, which may be excited thermally or optically by utilizing a heater, light emitting element or an optical fiber as drive means. Where a self-heating bimetal is used, electric leads may be connected thereto for energization. Bellows 50 may comprise a diaphragm formed of glass, synthetic resin, metal or the like. Spaces (2, 41, 46) in which the diaphragms are contained are filled with air in the described embodiment, but depending on the intended application, any other gas or liquid (for example, silicone oil, hydrocarbon or perfluorocarbon) may be confined in these spaces.

While a preferred embodiment of the invention has been illustrated and described, it is to be understood that there is no intention to limit the invention to the precise construction disclosed herein and the right is reserved to all changes and modifications coming within the scope of the invention as defined in the appended claims.

What is claimed is:

1. A micropump including an input port, an output port, a fluid channel space located between the input and the output port, a first oscillating member for opening or closing a communication between the fluid channel space and the input port, a second oscillating member for opening or closing a communication between the fluid channel space and the output port, and at least one third oscillating member for reducing/enlarging the fluid channel space;

characterized by pressure correcting means located outside the fluid channel space for applying a pressure, which is substantially equal to a fluid pressure at the input port, to a space in which the first oscillating member oscillates.

2. A micropump according to claim 1 in which the first oscillating member comprises a sheet which isolates between the space in which the first oscillating member oscillates and a space which communicates with the input port, and an oscillator disposed within the space in which the first oscillating member oscillates and to which the sheet is secured.

3. A micropump according to claim 2 in which a suction opening located between the space communicating with the input port and the fluid channel space and which is opened and closed by the sheet has an area of opening which faces the sheet less than the area of the sheet which faces the space in which the first oscillating member oscillates.

4. A micropump according to claim 1, further including stop means for restricting a movement of the third oscillating member in a direction to enlarge the volume of the fluid channel space.

5. A micropump according to claim 2, further including stop means for restricting a movement of the third oscillating member in a direction to enlarge the volume of the fluid channel space.

6. A micropump according to claim 3, further including stop means for restricting a movement of the third oscillating member in a direction to enlarge the volume of the fluid channel space.

7. A micropump comprising:

an intermediate plate including an input port and an output port which are spaced apart from each other and which extend through the plate in the direction of the thickness thereof, a suction opening located adjacent to the input port and extending through the plate in the direction of the thickness thereof and a suction valve seat which surrounds the opening, and a discharge opening located adjacent to the output port and extending through the plate in the direction of the thickness thereof and a discharge valve seat which surrounds the discharge opening;

a first oscillating member disposed in a space located on the side of the intermediate plate into which the suction valve seat projects, and including a thin sheet disposed opposite to the input port and the suction valve seat, and an oscillator to which the sheet is secured;

a second oscillating member disposed in a space located on the side of the intermediate plate into which the discharge valve seat projects, and including a thin sheet disposed opposite to the output port and the discharge valve seat, and an oscillator to which the sheet is secured;

a third oscillating member which faces the intermediate plate on the opposite side from the first oscillating member, and including a thin sheet which defines a fluid channel space communicating with the suction opening and the discharge opening together with the intermediate plate, and an oscillator to which the thin sheet is secured;

a cover member for forming a space in which the first oscillating member oscillates on the opposite side of the thin sheet of the first oscillating member from the intermediate plate;

and pressure correcting means for applying a pressure, which is substantially equal to a fluid pressure at the input port, to the space in which the first oscillating member oscillates.

8. A micropump according to claim 7 in which the suction opening has an area of opening which faces the thin sheet of the first oscillating member less than the area over which the thin sheet faces the space in which the first oscillating member oscillates.

9. A micropump according to claim 7, further including stop means for restricting a movement of the third oscillating member in a direction to enlarge the volume of the fluid channel space.

10. A micropump according to claim 8, further including stop means for restricting a movement of the third oscillating member in a direction to enlarge the volume of the fluid channel space.

* * * * *